US009943896B2

(12) United States Patent
Buck, Jr.

(10) Patent No.: US 9,943,896 B2
(45) Date of Patent: Apr. 17, 2018

(54) ADJUSTABLE COMPOUND BENDING JIG FOR MANUAL METAL BRAKE

(71) Applicant: Ronnie Lee Buck, Jr., Springfield, TN (US)

(72) Inventor: Ronnie Lee Buck, Jr., Springfield, TN (US)

( * ) Notice: Subject to any disclaimer, the term of this patent is extended or adjusted under 35 U.S.C. 154(b) by 69 days.

(21) Appl. No.: 14/616,632

(22) Filed: Feb. 6, 2015

(65) Prior Publication Data

US 2015/0217355 A1 Aug. 6, 2015

Related U.S. Application Data

(60) Provisional application No. 61/936,661, filed on Feb. 6, 2014.

(51) Int. Cl.
*B21D 5/00* (2006.01)
*B21D 5/04* (2006.01)

(52) U.S. Cl.
CPC ..... *B21D 5/042* (2013.01); *B21D 5/002* (2013.01)

(58) Field of Classification Search
CPC ..... B21D 5/002; B21D 5/042; B21D 5/04; B21D 5/05–5/047
USPC ..... 72/319–323, 389.3
See application file for complete search history.

(56) References Cited

U.S. PATENT DOCUMENTS 404,164 A 5/1889 Buckman
3,618,349 A * 11/1971 Roch ..... B21D 5/02 700/165
4,700,937 A 10/1987 Naylor
5,661,996 A 9/1997 Welty
5,761,939 A * 6/1998 Spencer ..... B21D 5/002 72/307
6,748,783 B1 6/2004 Chubb et al.
7,021,096 B2 * 4/2006 Barnett ..... B21D 11/22 72/31.1
7,043,950 B2 5/2006 Clark et al.
(Continued)

FOREIGN PATENT DOCUMENTS

JP 6411035 A 1/1989
JP 3221226 A 9/1991

OTHER PUBLICATIONS

International Search Report, dated Jun. 29, 2015 in corresponding PCT patent application No. PCT/US2015/14934.
(Continued)

*Primary Examiner* — Teresa M Ekiert
(74) *Attorney, Agent, or Firm* — Pitchford Fugett, PLLC; Mark A. Pitchford

(57) ABSTRACT

An adjustable jig for a sheet metal brake including a first arm configured to mount to the brake, and an adjustable backstop affixed on the first arm. The adjustable backstop is set at an adjustable first distance from a front face of the brake when the first arm is mounted to the brake. A first adjustable front stop can be configured to engage the first arm and retain an adjustable first front stop position relative to the first arm. A second adjustable front stop can be configured to engage the first arm and retain an adjustable second front stop position relative to the first arm. The first and second front stops are independently adjustable relative to the first arm. A sheet metal brake with an adjustable jig. A method for bending sheet metal with a sheet metal brake and an adjustable jig.

12 Claims, 10 Drawing Sheets

(56) References Cited

U.S. PATENT DOCUMENTS

| | | | |
|---|---|---|---|
| 7,412,862 | B2 | 8/2008 | Anderson et al. |
| 2003/0051526 | A1 | 3/2003 | Cleave et al. |
| 2005/0086991 | A1 | 4/2005 | Barnett |

OTHER PUBLICATIONS

International Preliminary Report on Patentability dated Aug. 9, 2016 in corresponding PCT patent application No. PCT/US2015/014934.

* cited by examiner

ADJUSTABLE COMPOUND BENDING JIG FOR MANUAL METAL BRAKE

CROSS-REFERENCES TO RELATED APPLICATIONS

This application is a non-provisional of U.S. Provisional Patent Application Ser. No. 61/936,661 filed on Feb. 6, 2014 entitled Adjustable Compound Bending Jig For Manual Metal Brake.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to manual metal brakes. More particularly, this invention pertains to reproducing bend patterns using a manual metal brake.

Most houses having aluminum or galvanized steel sheet metal fascia that is fabricated on site using a manual metal brake. An operator cuts a length of sheet metal from a roll (e.g., 8 feet to be bent by an 8 foot manual brake). The operator then sets a first end of a first edge of the cut sheet at a first depth in the brake. The operator then walks 8 feet to the second end of the first edge of the cut sheet and sets the second end of the first edge of the cut sheet at the first depth in the brake. Typically, the operator must return to the first and second ends another time or two as adjusting one end affects the insertion depth at the other end. When the operator is satisfied, he makes the first bend. The operator then flips the cut sheet end over end and/or front to back and begins aligning the cut sheet at a second insertion depth within the brake to make a second bend. For many types of fascia such as gable metal, four different bends can be required to make the fascia profile, such that this process must be repeated four times. This makes one 8 foot section of fascia.

The operator must then begin again by cutting another 8 foot section from the roll of sheet metal. The operator repeats this process until enough 8 foot sections are made to trim the house fascia. Walking back and forth to set both the first end and the second end at the proper insertion depth is time consuming and tedious. Further, any error means that the entire sheet is wasted, and the process must be restarted on another sheet. Any inaccuracy in measurements results in a poor fit between adjacent sections of fascia.

Steps similar to those used to make gable metal fascia can be used to fabricate other siding sections such as gutter metal, window undersills, window casing, j channel, corner posts, soffits, and rake edges. Such processes can be immensely time consuming and produce high labor costs.

What is needed, then, are improvements to sheet metal brakes.

BRIEF SUMMARY

One aspect of the present disclosure is a sheet metal brake including an adjustable jig, said adjustable jig including a first arm configured to mount to the sheet metal brake and an adjustable backstop movably disposed on the first arm. The adjustable backstop is set at an adjustable first distance from a front face of the brake when the first arm is mounted to the sheet metal brake. The adjustable jig includes an adjustable front stop configured to engage the first arm and retain an adjustable front stop position relative to the first arm, wherein the adjustable front stop has a pivoting tip movable between a substantially horizontal orientation and a substantially vertical orientation when the first arm is mounted to the sheet metal brake and in the upright position and the adjustable front stop is engaging the first arm.

Another aspect of the present disclosure is an adjustable jig for a sheet metal brake, the adjustable jig including a first arm configured to mount to the sheet metal brake, and an adjustable backstop affixed on the first arm. The adjustable backstop is set at an adjustable first distance from a front face of the brake when the first arm is mounted to the sheet metal brake. A first adjustable front stop is configured to engage the first arm and retain an adjustable first front stop position relative to the first arm. A second adjustable front stop is configured to engage the first arm and retain an adjustable second front stop position relative to the first arm. The first and second adjustable front stops are independently adjustable relative to the first arm.

The use of multiple adjustable front stops can allow an operator to reduce the amount of time measuring multiple sections of sheet metal that require bending. The operator can measure a first section of sheet metal, and for each bend, the operator can move one of the adjustable front stops into position against the sheet metal section to mark the proper position of the sheet metal section for each bend. For a second section of sheet metal, the operator can position the second sheet metal section in the sheet metal brake against the front stops of the adjustable jig in sequence and make proper bends without having to remeasure the second section of sheet metal.

Another aspect of the present disclosure is a method for bending a section of sheet metal with a sheet metal brake and an adjustable jig including the steps of (a) positioning the sheet metal section in the sheet metal brake with a first front face of the sheet metal against a first adjustable front stop of the adjustable jig; (b) making a first bend in the sheet metal section with the sheet metal brake; (c) repositioning the sheet metal section in the sheet metal brake with a second front face of the sheet metal against a second adjustable front stop of the adjustable jig; and (d) making a second bend in the sheet metal section with the sheet metal brake.

Numerous other objects, advantages and features of the present invention will be readily apparent to those of skill in the art upon a review of the following drawings and description of a preferred embodiment.

BRIEF DESCRIPTION OF THE SEVERAL VIEWS OF THE DRAWINGS

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION

Figure 1:
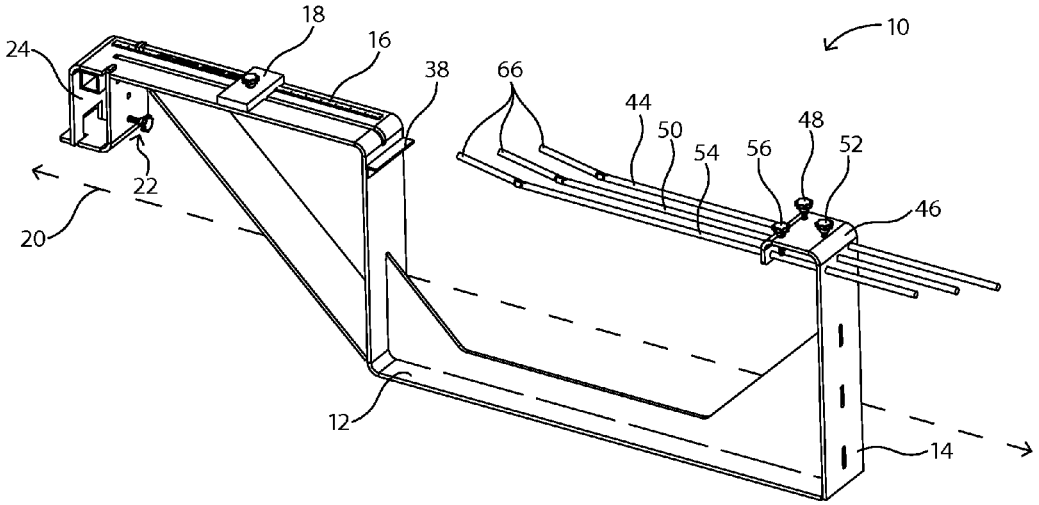
FIG. 1 is a perspective view of an embodiment of an adjustable jig for a sheet metal brake.

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the apparatuses and/or methods disclosed and claimed herein may be made and/or executed without undue experimentation in light of the present disclosure. While the apparatuses and methods of this invention have been described in terms of the embodiments included herein, it will be apparent to those of ordinary skill in the art that variations may be applied to the apparatuses and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Figure 2:
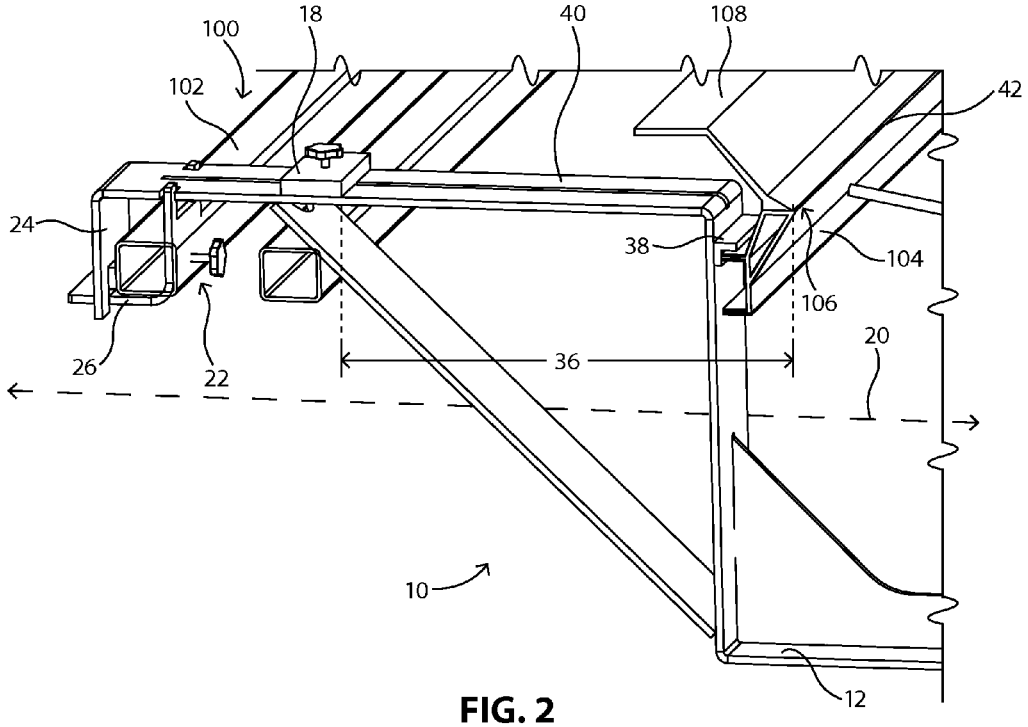
FIG. 2 is a partial perspective view of the adjustable jig of FIG. 1 mounted to a sheet metal brake.
Figure 3:
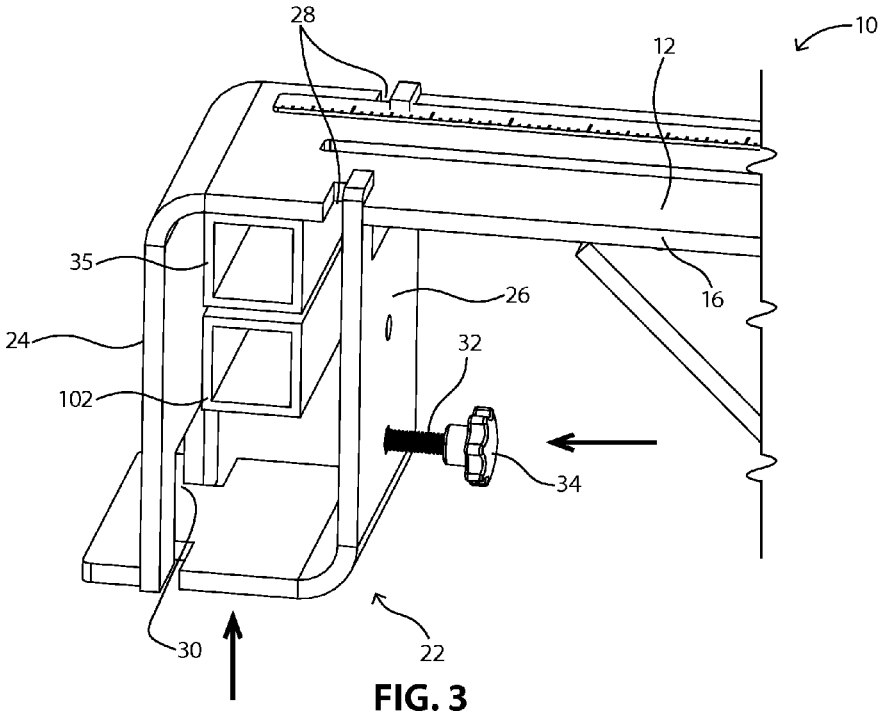
FIG. 3 is a detailed view of a brake clamp for the adjustable jig of FIG. 1.

An embodiment of an adjustable jig device 10 for a sheet metal brake is shown in FIG. 1. The jig 10 includes a first arm 12 that is configured to mount to a sheet metal brake. The first arm 12 can include a front portion 14 and a back portion 16. As shown in FIG. 2 and FIG. 3, in some embodiments the adjustable jig 10 can be configured to mount to a rear rail 102 of the sheet metal brake 100. The adjustable jig 10 can include a brake clamp 22 that can effectively clamp the first arm 12 to the rear rail 102 of the sheet metal brake 100, and thus mount the adjustable jig 10 to the sheet metal brake 100. The back portion 16 of the first arm 12 can have a rear downward extension 24 that can be positioned behind the rear rail 102 when the first arm 12 is positioned on the sheet metal brake 100. The brake clamp 22 can include a brake clamp plate 26 that can be configured to engage the back portion 16 of the first arm 12 and the downward extension 24. The back portion 16 can include at least a first notch 28 and the rear downward extension 24 can include at least a second notch 30. Portions of the brake clamp plate 26 can be received through the first and second notches 28 and 30. The brake clamp 22 can include a threaded bolt 32 with a knob 34 that can be inserted through the brake clamp plate 26 and tightened until the rear rail 102 is clamped against the rear downward extension 24, thus mounting the first arm 12 and the back portion 16 to the rear rail 102 of the sheet metal brake 100.

In some embodiments, the back portion 16 of the first arm 12 can include a spacing member 35 proximate the rear downward extension 24. The spacing member 35 can be positioned on top of the rear rail 102 when the first arm 12 is positioned on the sheet metal brake 100 such that when the threaded bolt 32 is tightened, the rear rail 102 of the sheet metal brake 100 can be clamped both laterally and vertically by the brake clamp plate 26, thus helping reduce any movement of the first arm 12 on the sheet metal brake 100.

The sheet metal brake 100 can also include a front rail 104 which includes in a front face 106 of the sheet metal brake 100. The sheet metal brake 100 includes a platen 108 that is movable on the brake 100 and can have a flat lower surface such that when a section of sheet metal is positioned in the sheet metal brake 100, the platen 108 can be moved into a clamped position such that the lower surface of the platen 108 presses against the section of sheet metal clamping it in place on the sheet metal brake 100. The section of sheet metal can subsequently be bent around the platen 108 to form a bend in the section of sheet metal.

The first arm 12 can also include a flange 38 protruding from a front edge of the back portion 16 of the first arm 12. The flange 38 can be configured to rest on the front rail 104 of the sheet metal brake 100 when the first arm 12 is mounted to the sheet metal brake 100 such that the front portion of the first arm 12 can be cantilevered in front of the front face 106 of the sheet metal brake 100. The flange 108 can also help orient the first arm 12 such that an upper surface 40 of the back portion 16 of the first arm 12 is substantially coplanar with an upper surface 42 of the front rail 104 of the sheet metal brake 100.

The jig 10 can include an adjustable backstop 18 affixed on the first arm 12. In some embodiments, the adjustable backstop 18 can be movably or slidably disposed on the back portion 16 of the first arm 12. The adjustable backstop 18 can be a block or generally have a rectangular shape having a flat leading face in some embodiments such that a section of sheet metal can rest on the back portion 16 of the first arm 12 flush against the adjustable backstop 18, the section of sheet metal resting squarely on the back portion 16 of the first arm 12 such that an edge of the sheet metal positioned against the adjustable backstop 18 is oriented substantially perpendicularly to a longitudinal axis 20 of the adjustable jig 10.

Figure 4:
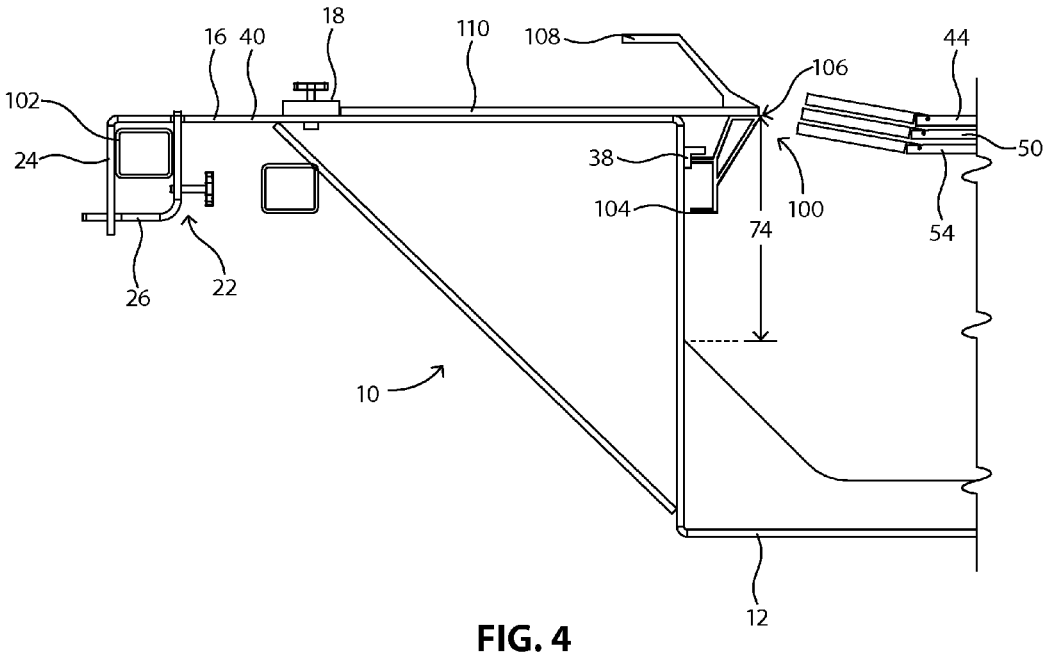
FIG. 4 is a partial front elevation view of the adjustable jig of FIG. 1 mounted to a sheet metal brake.

The adjustable backstop 18 is configured to be set at a first distance 36 from the front face 106 of the sheet metal brake 100 when the first arm 12 is mounted on the sheet metal brake 100. As such, the position of the adjustable backstop 18 can be varied to define a desired first distance 36 between a leading edge of the adjustable backstop 18 and the front face 106 of the sheet metal brake 100. As shown in FIG. 4, a section of sheet metal 110 can be positioned flush against the adjustable backstop 18 and the platen 108 can clamp the section of sheet metal 110 down. The section of sheet metal 110 can be scored along a front edge of the platen 108 with a utility knife or other suitable cutting tool in order to cut the section of sheet metal 110.

In some embodiments, the front edge of the platen 108 can be substantially coplanar with the front face 106 of the sheet metal brake 100. In other embodiments, the front edge of the platen 108 can be set back from the front face 106 of the sheet metal brake 100 a predetermined distance. In some embodiments, the upper surface 40 of the back portion 16 of the first arm 12 can include measurements indicating the distance from a given mark to the front edge of the platen 108. As such, the measurements can be used to affix the adjustable backstop 18 at a desired location on the back portion 16 of the first arm 12 such that when a section of sheet metal is positioned against the adjustable backstop 18 and the platen 108 is clamped down onto the section of sheet metal, by scoring the section of sheet metal 110 along the front edge of the platen 108, an operator can cut the section of sheet metal to a desired length.

Referring again to FIG. 1, the adjustable jig 10 includes a first adjustable front stop 44 configured to engage the first arm 12 and retain an adjustable first front stop position relative to the first arm 12. The front portion 14 of the first arm 12 can include a front clamp flange 46. The first adjustable front stop 44 can be inserted through the front clamp flange 46. The first adjustable front stop 44 is movable on the front clamp flange 46 such that the first front stop position relative to the first arm 12 can be varied as desired by the operator. The first adjustable front stop 44 can be moved as desired toward and away from the back portion 16 of the first arm 12 and the front face of a sheet metal brake when the first arm 12 is mounted to the sheet metal brake. The adjustable jig 10 can include a first front stop clamp 48 disposed on the first arm 12 that is configured to retain the first adjustable front stop 44 in an adjustable first front stop position relative to the first arm 12. The first front stop clamp 48 can include a threaded bolt and a knob similar to that of the brake clamp 22, such that the first front stop clamp 48 can be tightened on the front clamp flange 46 to retain the first adjustable front stop 44 in a desired position.

The adjustable jig 10 can also include a second adjustable front stop 50 configured to engage the first arm 12 and retain an adjustable second front stop position relative to the first arm 12. The second adjustable front stop 50 can similarly be inserted through the front clamp flange 46 and be movable on the front clamp flange 46 such that the second front stop position relative to the first arm 12 can be varied as desired. The adjustable jig 10 can also include a second front stop clamp 52 disposed on the first arm 12. The second front stop clamp 52 can be configured to retain the second adjustable front stop in a desired second front stop position relative to the first arm 12. The second adjustable front stop can also move toward and away from the back portion 16 of the first arm 12 and a sheet metal brake when the first arm 12 is mounted to the sheet metal brake. The first and second adjustable front stops 44 and 50 can be adjustable independently on the first arm 12 such that the first and second adjustable front stops 44 and 50 can be offset from one another relative to the first arm 12.

The adjustable jig 10 can also include a third adjustable front stop 54 configured to engage the first arm 12 and selectively retain a third front stop position relative to the first arm 12. The third adjustable front stop 54 can be similarly inserted through the front clamp flange 46 and be movable on the front clamp flange 46 such that the third front stop position relative to the first arm 12 can be varied as desired. The adjustable jig 10 can include a third stop clamp 56 disposed on the first arm 12, the third stop clamp 56 configured to retain the third adjustable front stop 54 in an adjustable third front stop position relative to the first arm 12. The third adjustable front stop 54 can also move toward and away from the back portion 16 of the first arm 12 and the front face of a sheet metal brake when the first arm 12 is mounted to the sheet metal brake. The first, second, and third adjustable front stops 44, 50, and 54 can be adjustable independently relative to the first arm 12.

Figure 6:
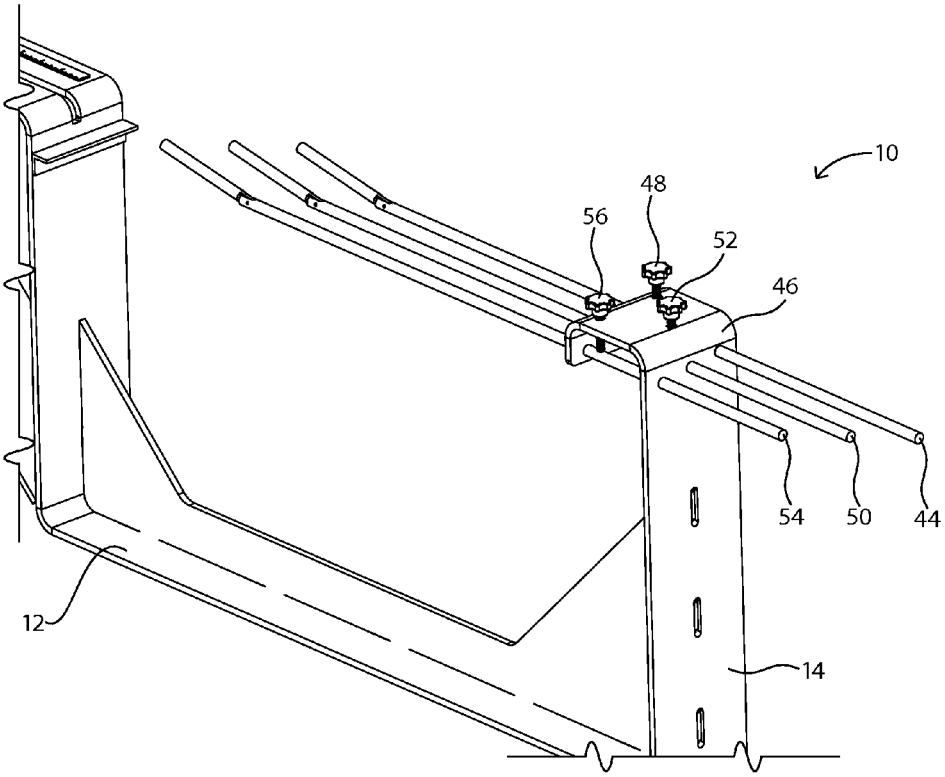
FIG. 6 is a detailed perspective view of the adjustable jig of FIG. 1 showing first, second, and third front stop clamps in a first orientation.
Figure 7:
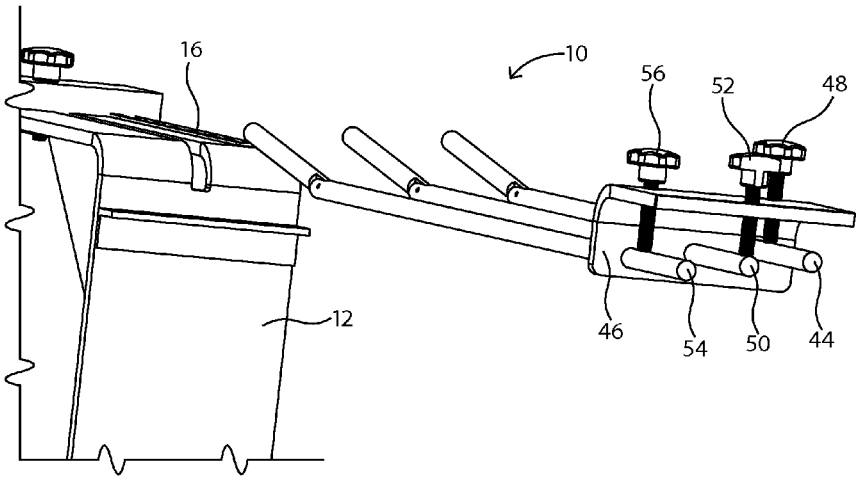
FIG. 7 is a cutaway view of the adjustable jig of FIG. 6 showing the first, second, and third front stop clamps engaging the first, second, and third front stops respectively.

With respect to the first, second, and third stop clamps 48, 52, and 56, a first orientation of the stop clamps 48, 52, and 56 on the front clamp flange 46 is shown in FIG. 6 and FIG. 7. In some embodiments, the first, second, and third stop clamps 48, 52, and 56 can be staggered on the front clamp flange 46, with the first and third stop clamps 48 and 56 located on the back of the front clamp flange 46, and the second stop clamp 52 located on the front of the front clamp flange 46. This arrangement can help provide clearance for an operator's hand as the operator attempts to tighten the first, second and third stop clamps 48, 52, and 56 on the first, second, and third adjustable front stops 44, 50, and 54 respectively.

Figure 8:
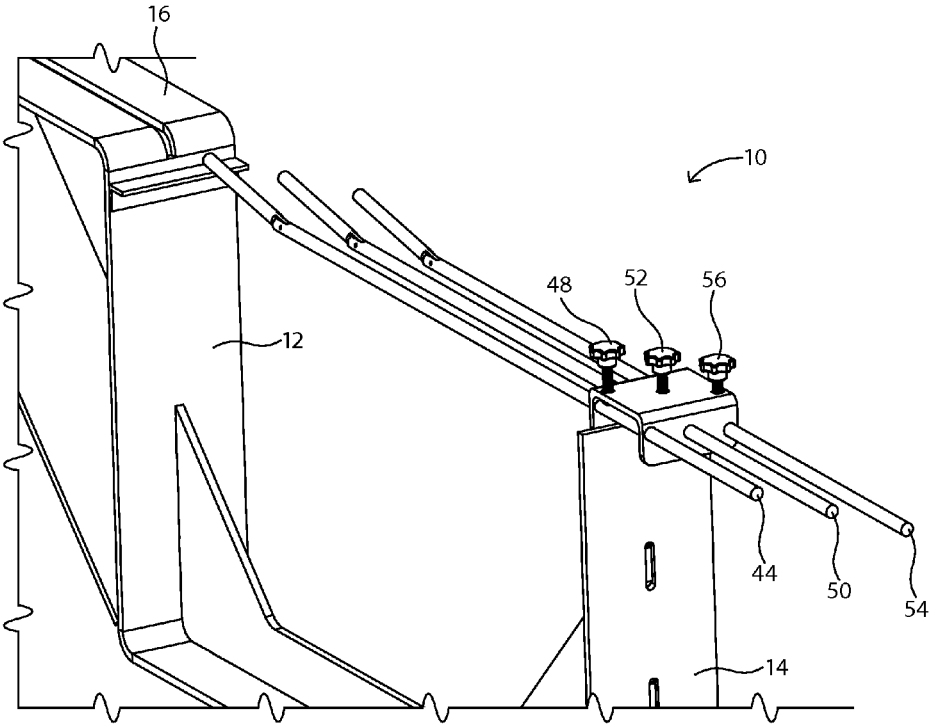
FIG. 8 is a detailed perspective view of the first, second, and third stop clamps of FIG. 6 shown in a second orientation.

A second orientation of the first, second, and third stop clamps on the front clamp flange 46 is shown in FIG. 8. In the orientation shown, the first, second, and third stop clamps 48, 52, and 56 are oriented diagonally across the front clamp flange 46.

Figure 9:
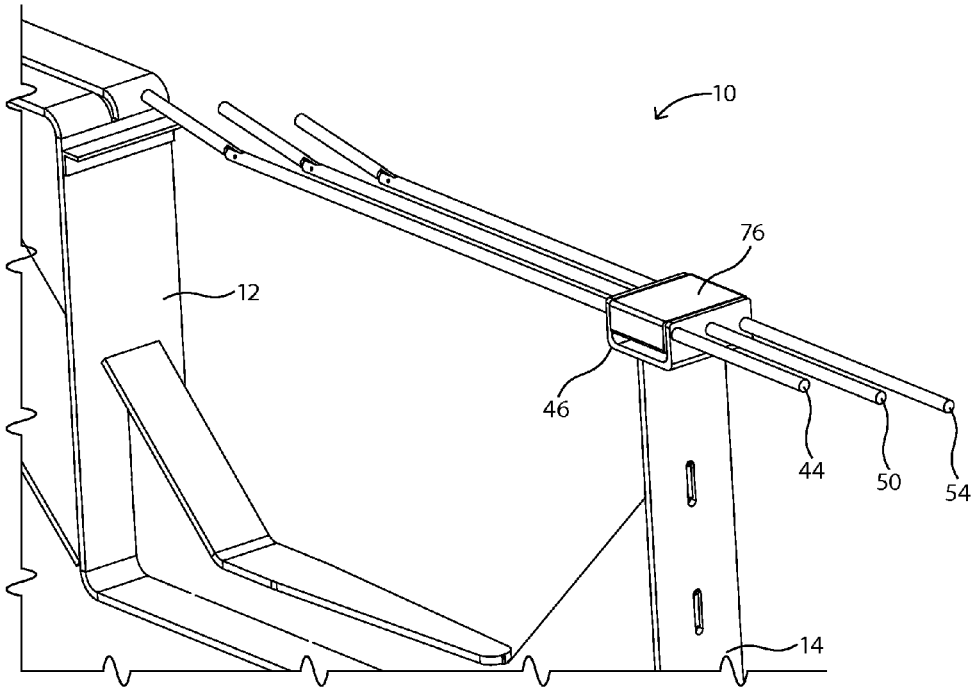
FIG. 9 is a detailed perspective view of another embodiment of an adjustable jig having a spring-biased stop clamp block.
Figure 10:
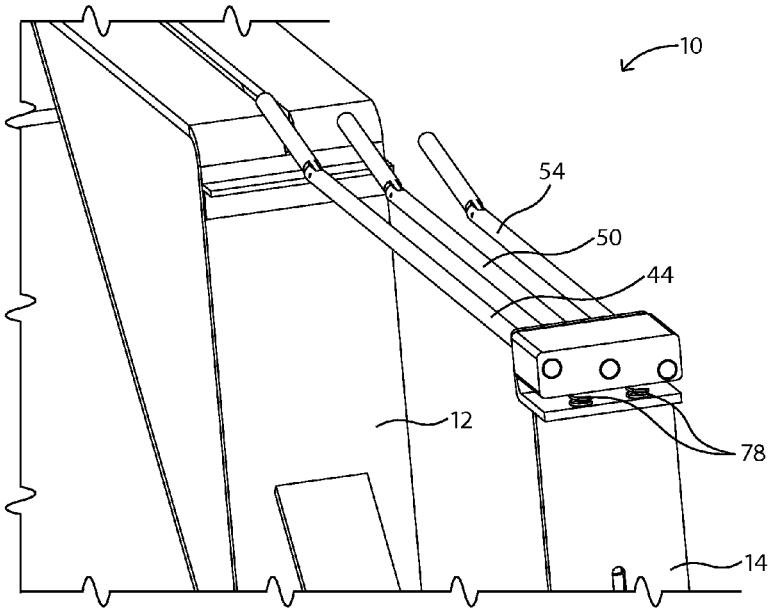
FIG. 10 is a cross sectional view of the spring-biased stop clamp block of FIG. 9.

A second embodiment of a clamping mechanism for the first, second, and third adjustable front stops 44, 50, and 54 is shown in FIG. 9 and FIG. 10. The adjustable jig 10 includes a stop clamp block 76 disposed on the front clamp flange 46. Each of the first, second, and third adjustable front stops 44, 50, and 54 are inserted through the stop clamp block 76 as well as through the front clamp flange 46. The stop clamp block 76 can be biased by a plurality of springs 78 in a raised position, such that the stop clamp block 76 clamps the first, second, and third adjustable front stops 44, 50, and 54 in the adjustable first, second, and third front stop positions respectively. If one of the front stops needs adjusting, the stop clamp block can be depressed such that the front stops 44, 50, and 54 are free to move relative to the first arm 12. When the front stops are in the proper position the stop clamp block 76 can be released to once again clamp the adjustable front stops 44, 50, and 44.

As such, when the first arm 12 is mounted to the sheet metal brake, the first adjustable front stop 44 is movable to a first desired set point relative to the front face of the brake, the second adjustable front stop 50 is movable to a second desired set point relative to the front face of the brake, and the third adjustable front stop 54 is movable to a third desired set point relative to the front face of the brake. The first, second, and third desired set points can be offset from one another. The actual position of the first, second, and third set points can be varied as needed by an operator. The set points can correspond to different dimensions for different bends that are desired to be made in a section of sheet metal.

Figure 5:
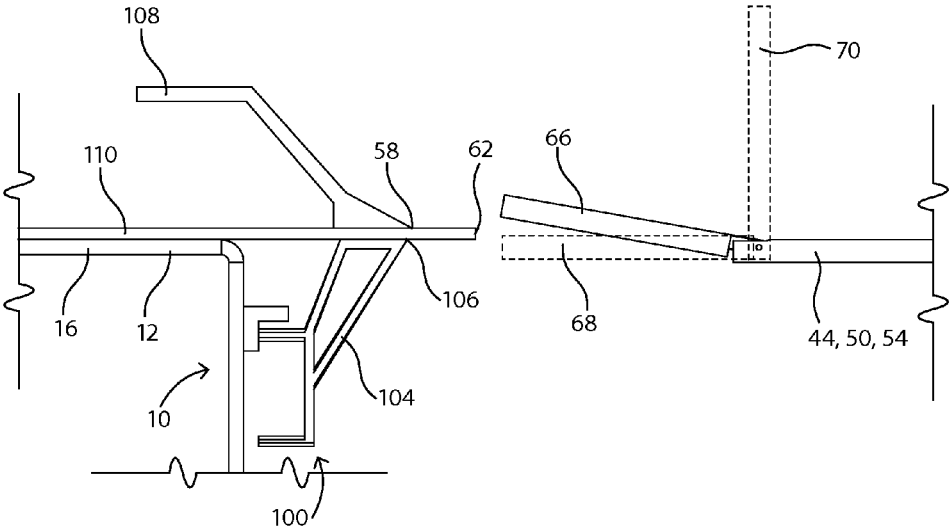
FIG. 5 is a detailed front elevation view showing a pivoting tip of an adjustable front stop of the adjustable jig of FIG. 1 positioned in front of a sheet metal brake.
Figure 18A:
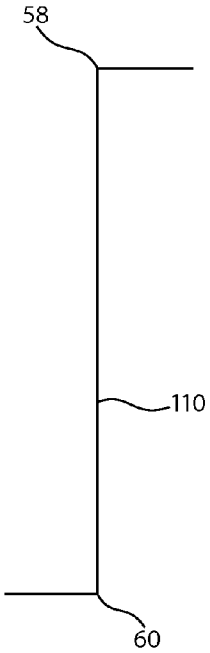
FIG. 18*a* is a side view of a typical gutter metal fascia profile.

For instance, for a section of sheet metal 110 that includes a first desired bend point 58 and a second desired bend point 60, as seen in FIG. 18*a*, an operator can cut the section of sheet metal 110 to a desired overall length, and can then measure a first desired bend point 58 in the section of sheet metal 110 where a first bend is to be made. The operator can then position the section of sheet metal 110 in the sheet metal brake 100 such that the first desired bend point 58 is aligned with the front edge of the platen 108, and the operator can clamp down the platen 108 on the section of sheet metal 110, as shown in FIG. 4 and FIG. 5. The first adjustable front stop 44 can then be moved to a first desired set point with the first adjustable stop 44 positioned against a first front face 62 of the section of sheet metal 110 to mark the position of the section of sheet metal 110 for the first bend. The first front stop clamp can then be tightened to retain the first adjustable front stop 44 at the first desired set point. The first bend can then be made in the section of sheet metal 110. The first bend can create a second front face of the section of sheet metal 110.

A similar sequence of steps can be performed for the second bend with an operator measuring the point on the section of sheet metal 110 for the second bend and positioning the section of sheet metal 100 in the sheet metal brake 110 with the second desired bend point aligned with the front edge of the platen 108 and subsequently clamping the platen 108 down on the section of sheet metal 110. The second adjustable front stop 50 can be moved to a second desired set point relative with the second adjustable front stop 50 positioned against the second front face of the sheet metal 110 to mark the position of the sheet metal 110 for the second bend. A second bend can then be formed in the section of sheet metal 110. The second bend creates a third front face in the section of sheet metal as a second portion of the metal is bent during the second bend.

A front face of a section sheet metal 110 is defined as the face of the section of sheet metal 110 at any given point in time that faces towards the front portion of the first arm 12, or the face of the section of sheet metal 110 extending out of the front of the sheet metal brake 100. As such, the first front face 62 is the face or edge of the section of sheet metal 110 extending out from the sheet metal brake 100 when the section of sheet metal 110 is positioned for the first bend. The second front face is the face or edge of the section of sheet metal 110 extending out of the sheet metal brake 100 when the section of sheet metal 110 is in position for the second bend, etc.

Since the first and second adjustable front stops are retained at the first and second desired set points, an operator does not have to remeasure a second section of sheet metal to make another fabricated section of sheet metal. The second section of sheet metal can simply be positioned in the sheet metal brake 100 with a first front face of the second section of sheet metal positioned against the first adjustable front stop 44, and the first bend can be made. The second section of sheet metal can then repositioned in the sheet metal brake 100 with a second front face of the second section of sheet metal positioned against the second adjustable front stop 50, and the second bend can be made. Thus, the adjustable jig device 10 can help reduce the time to fabricate multiple sections of sheet metal as the measurements for the different bends only have to be taken once. A reduction in fabrication time can help make the sheet metal bending process more efficient which can help reduce labor cost.

Figure 18B:
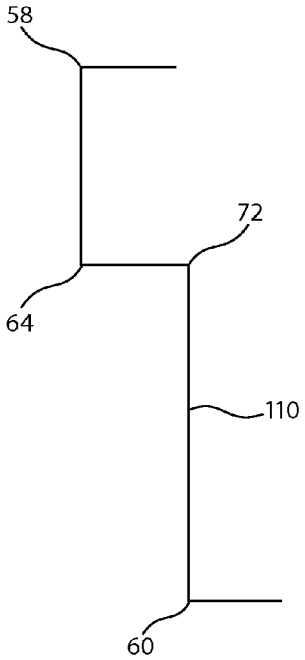
FIG. 18*b* is a side view of a typical gable metal fascia profile.

For those sections of sheet metal requiring a third desired bend point 64, such as the sheet metal profile of FIG. 18*b*, the same steps as described above can be utilized, and additionally the third desired bend point 64 can be measured on the section of sheet metal 110. Referring again to FIGS. 4 and 5, the section of sheet metal 110 can be positioned in the sheet metal brake 100 with the third desired bend point aligned with the front edge of the platen 108 and the platen 108 can be clamped down on the section of sheet metal 110. The third adjustable stop 54 can then be positioned in a third desired set point against a third front face of the section of sheet metal 110 and the third clamp can be tightened to retain the third adjustable front stop 54 at the third desired set point. A third bend could then be made in the sheet metal. For a second section of sheet metal to be fabricated, the first and second bends could be made in the second section of sheet metal as previously described, and then the second section of sheet metal could be repositioned in the sheet metal brake with a third front face of the second section of sheet metal positioned against the third adjustable front stop 54. The third bend could then be made in the second section of sheet metal.

Figure 16:
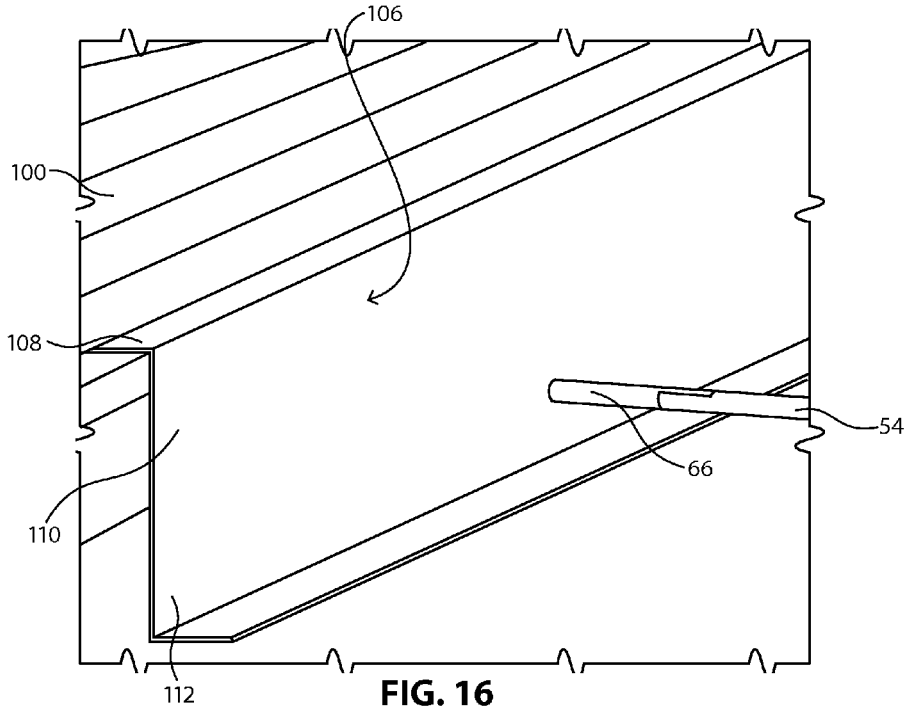
FIG. 16 is a detailed view of a section of sheet metal positioned in the sheet metal brake of FIG. 12 with a portion of the sheet metal section extending in a downward direction from a front face of the sheet metal brake in preparation for a fourth bend.

In many types of sheet metal designs, such as gable metal fascia shown in FIG. 18*b*, a fourth bend point 72 is needed in a section of sheet metal 110 to create the proper profile of the gable metal. However, after three bends in the section of sheet metal, the section of sheet metal 110 can have an overall L-shaped profile. As such, in order to make the fourth bend in the section of sheet metal 110, it is often necessary to position the section of sheet metal 110 in the sheet metal brake 100 with a portion 112 of the sheet metal extending in a downward direction from the front face 106 of the sheet metal brake 100, as shown in FIG. 16. In order to help accommodate this type of bend, in some embodiments when the first arm 12 is mounted to the sheet metal brake 100, the first arm 12 of the adjustable jig 10 can extend below the platen 108 by an offset distance 74, as seen in FIG. 4. The offset distance between the first arm 12 and the platen 108 can allow a section of the sheet metal 110 to extend downward from a front face 106 of the sheet metal brake 100 without interference from the first arm 12. In some embodiments, the offset distance 74 can be at least six inches. In other embodiments, the offset distance can be at least 12 inches.

As a fourth bend is made in the section of sheet metal 110, the portion 112 of the section of sheet metal 110 extending downward from the front face 106 of the sheet metal brake 110, shown in FIG. 16, can potentially engage the tip of the third adjustable front stop 54. Interference from the third adjustable front stop 54 can potentially cause the section of sheet metal 110 to tear or rip.

Referring again to FIG. 1, in some embodiments, the third adjustable front stop 54 can have a pivoting tip 66. When the first arm 12 is mounted on the sheet metal brake 100 and in an upright position and the third adjustable front stop 54 is engaging the first arm 12, as shown in FIGS. 4 and 5, the pivoting tip 66 can move between a substantially horizontal orientation 68 and a substantially vertical orientation 70. As such, as the fourth bend is being made, any portion of the section of sheet metal 110 engaging the third adjustable front stop 54 can engage the pivoting tip 66 and can move the pivoting tip 66 from the horizontal orientation 68 to the vertical orientation 70. The pivoting tip 66 can allow the a fourth bend in the sheet metal 110 to be made without significant interference from the third adjustable front stop 54. In some embodiments, the pivoting tip can be biased in the horizontal orientation 68 by an internal spring or other suitable biasing member, such that the horizontal orientation 68 is a default orientation for the pivoting tip 66.

Referring again to FIG. 1, in some embodiments, each of the first, second, and third adjustable front stops 44, 50, and 54 can have a pivoting tip 66 movable between a substantially horizontal orientation and a substantially vertical orientation. As such, significant interference from any of the first, second, or third adjustable front stops 44, 50, and 54 on the sheet metal during a fourth bend can be minimized. In other embodiments, one or more of the first, second, or third adjustable front stops 44, 50, and 54 can be solid rods.

Figure 11:
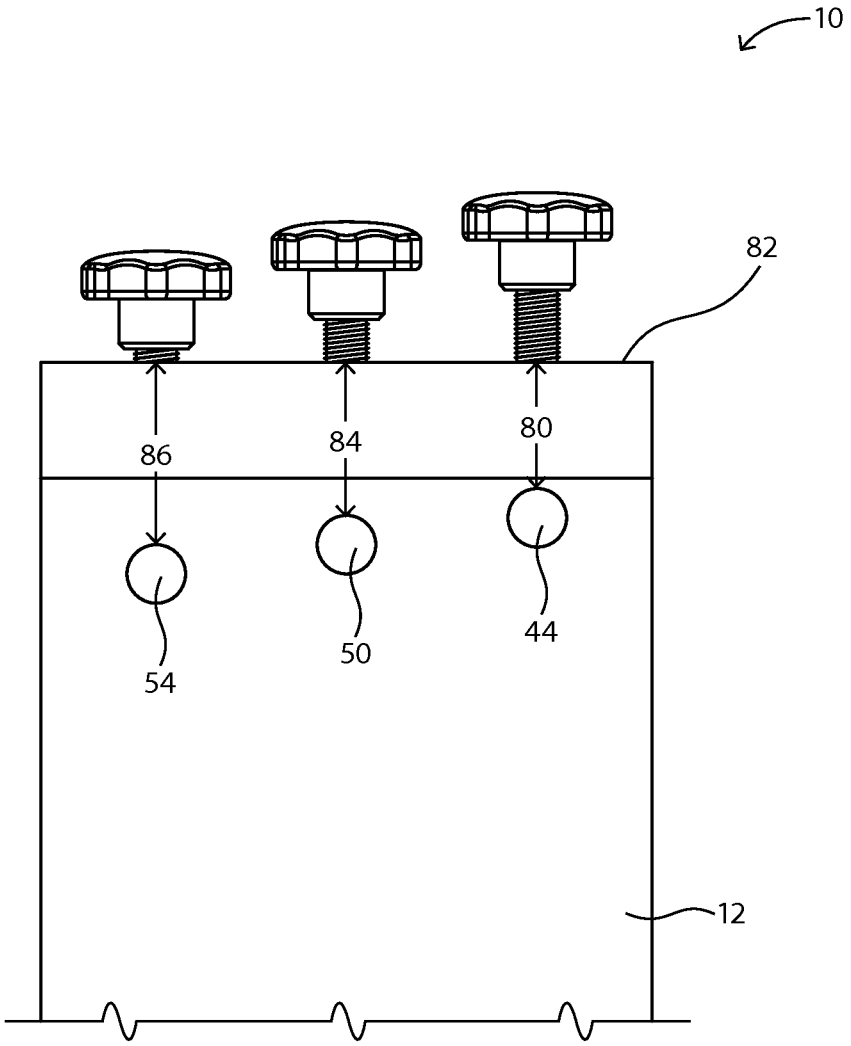
FIG. 11 is a partial side elevation view of the adjustable jig of FIG. 1 showing different elevations of the first, second, and third adjustable front stops.

Referring now to FIG. 11, in some embodiments, when the first arm 12 is mounted on the sheet metal brake, the first adjustable front stop 44 can have a first elevation, the second adjustable front stop 50 can have a second elevation, and the third adjustable front stop 54 can have a third elevation. The first elevation can be higher than the second elevation, and the second elevation can be higher than the third elevation. As such, the first adjustable front stop 44 can be positioned higher than the second adjustable front stop 50 and the second adjustable front stop 50 can be positioned higher than the third adjustable front stop 54. The distance 80 between the first adjustable front stop and the top 82 of the front clamp flange 46 can be less than the distance 84 between the second adjustable front stop 50 and the top 82 of the front clamp flange 46, and the distance 84 can be less than the distance 86 between the third adjustable front stop 54 and the top 82 of the front clamp flange 46. As such, when a section of sheet metal is positioned in the sheet metal brake and a front face is positioned against one of the front stops 44, 50, and 54, having the front stops 44, 50, and 54 at offset elevations can help prevent one front stop from interfering with the section of sheet metal being positioned against another front stop.

Additionally, having descending elevations for the front stops 44, 50, and 54 can potentially help prevent the sheet metal from sagging during the bending operation. For instance, if a section of sheet metal is being positioned with a front face against the first adjustable front stop 44, the section of sheet metal can rest on the second adjustable stop 50 which is positioned slightly lower than the first adjustable stop 44. As such, the second adjustable stop 50 can help prevent the section of sheet metal from sagging to help ensure the section of sheet metal is positioned properly for the first bend.

Figure 12:
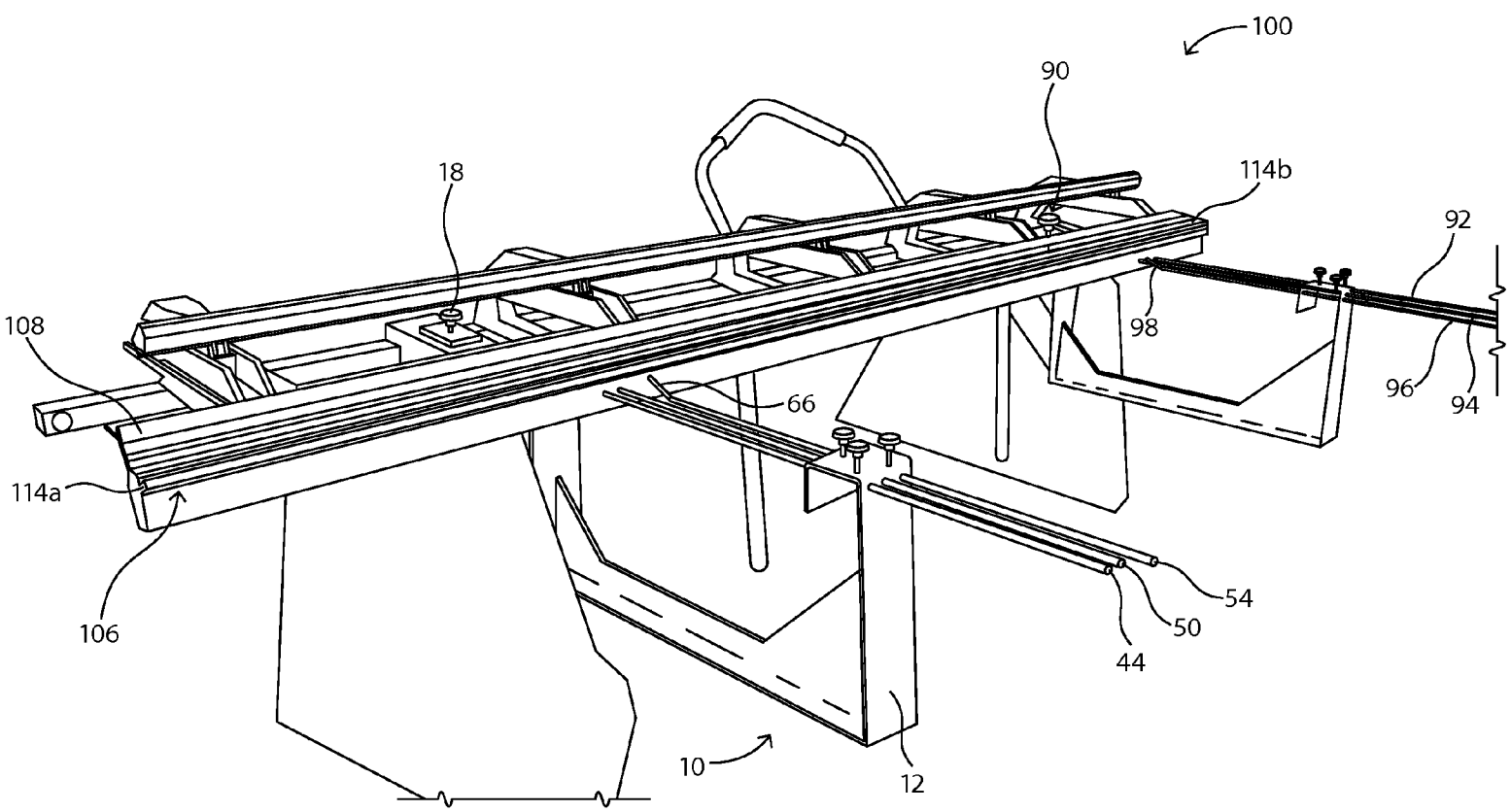
FIG. 12 is a perspective view of an embodiment of a sheet metal break with an adjustable jig mounted to the sheet metal brake.

An embodiment of a sheet metal brake 100 is shown in FIG. 12. The sheet metal brake 100 can include an adjustable jig 10. The adjustable jig 10 of the embodiment of FIG. 12 can be similar to the previous embodiments of the adjustable jig 10 herein described and can include a first arm 12 mountable to the sheet metal brake 100 and multiple components on the first arm 12, including adjustable front stops 44, 50, and 54 configured to engage the first arm 12 and retain adjustable front stop positions relative to the first arm 12.

In some embodiments, the adjustable jig 10 of the sheet metal brake 100 may further include a second arm 88 configured to mount to the sheet metal brake 100. A second adjustable backstop 90 can be movably disposed on the second arm 88. In some embodiments, the adjustable jig 10 can include a second arm first adjustable front stop 92 configured to engage the second arm 88 and retain an adjustable second arm first front stop position relative to the second arm 88. The adjustable jig 10 can include a second arm second adjustable front stop 94 configured to engage the second arm 88 and retain a second arm second front stop position relative to second arm 88. In some embodiments, the adjustable jig 10 can further include a second arm third adjustable front stop 96 configured to engage the second arm 88 and retain an adjustable second arm third stop position. The second arm first, second, and third adjustable front stops 92, 94, and 96 can be independently adjustable on the second arm 88.

In some embodiments, each of the third adjustable front stop 54 and the second arm third adjustable front stop 96 can include a pivoting tip 66 movable between a substantially horizontal position and a substantially vertical position when the first and second arms 12 and 88 are mounted to the sheet metal brake 100 in an upright position. In some embodiments each of the first, second, and third adjustable front stops and each of the second arm first, second, and third front stops can have a pivoting tip 66 movable between a substantially horizontal position and a substantially vertical position when the first and second arms 12 and 88 are mounted to the sheet metal brake 100 in an upright position.

In some embodiments, the first arm 12 can be configured to mount to a first end 114*a* of the sheet metal brake 100 and the second arm 88 can be configured to mount to a second end 114*b* of the sheet metal brake 100. The first arm 12 and the second arm 88 can therefore be positioned on opposing ends of the sheet metal brake 100. As such, a section of sheet metal positioned in the sheet metal brake 100 can be positioned against one front stop on the first arm 12 and a corresponding front stop on the second arm 88. Having two reference points along a front face of the a section of sheet metal for a bend can help ensure accurate bending.

Figure 13:
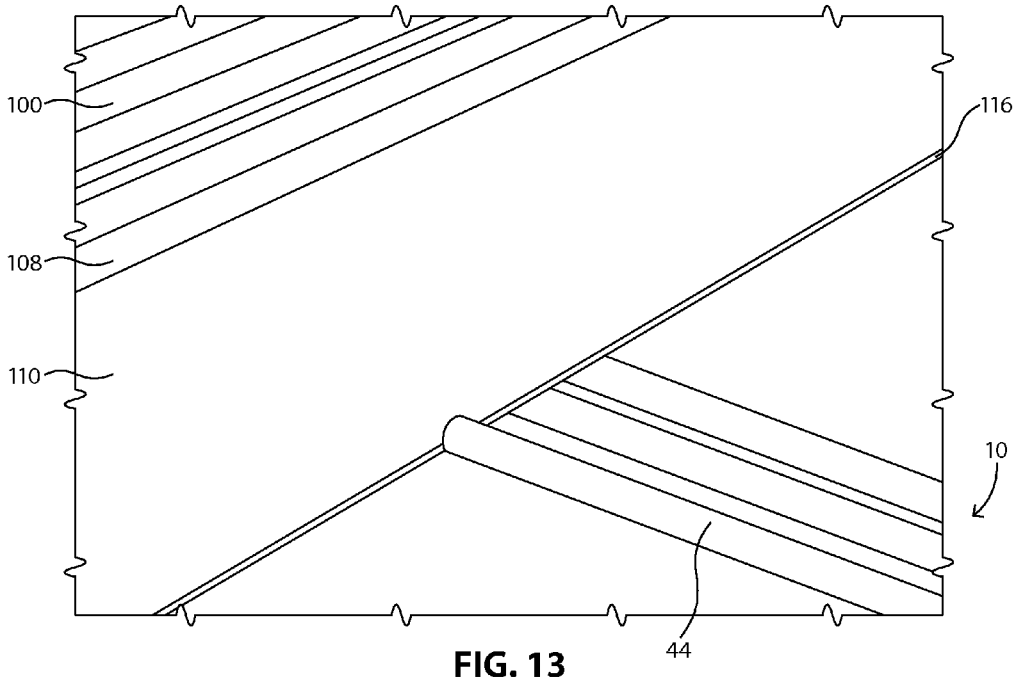
FIG. 13 is a detailed view of a section of sheet metal positioned in the sheet metal brake of FIG. 12 with a first face of the sheet metal section positioned against a first adjustable front stop of an adjustable jig mounted to the sheet metal brake in preparation for a first bend.
Figure 14:
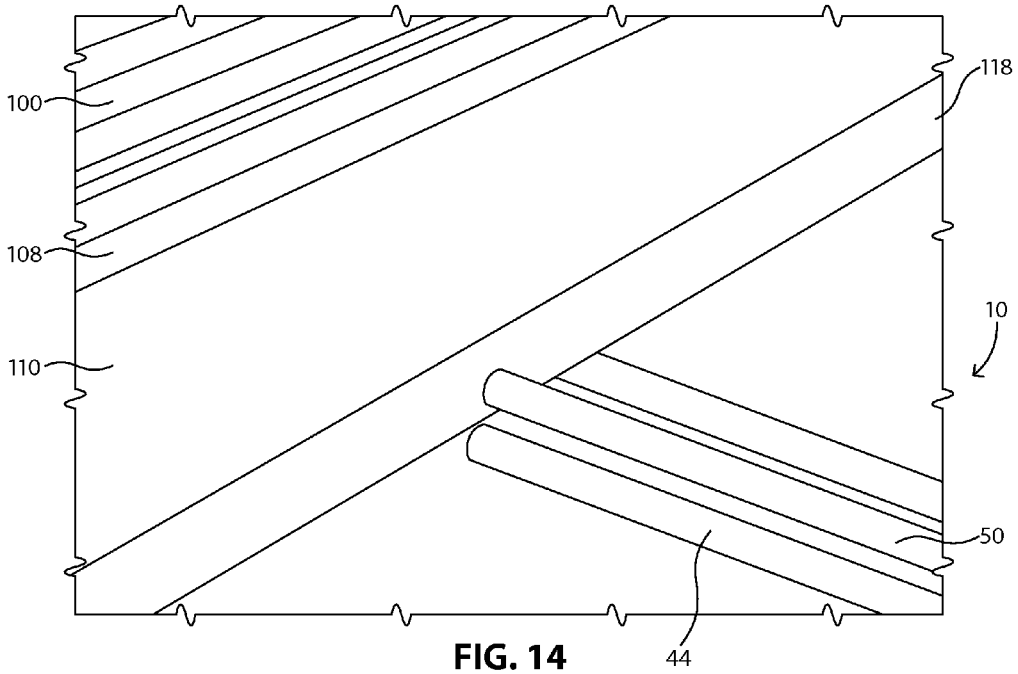
FIG. 14 is a detailed view of a section of sheet metal positioned in the sheet metal brake of FIG. 12 with a second face of the sheet metal section positioned against a second adjustable front stop of an adjustable jig mounted to the sheet metal brake in preparation for a second bend.

A method for bending a section of sheet metal 110 with a sheet metal brake 100 and an adjustable jig 10 similar to the jig 10 previously described herein is shown in FIGS. 13-17. The method includes positioning the sheet metal section 110 in the sheet metal brake 100 with a first face 116 of the sheet metal section 110 against a first adjustable front stop 44 of the adjustable jig 10 as shown in FIG. 13, and making a first bend in the sheet metal section 110 with the sheet metal brake 100. During the first bend, a second face 118, shown in FIG. 14, can be produced as a portion of the sheet metal section is bent to produce a second face 118 of the sheet metal section 110. The method further includes repositioning the sheet metal section 110 in the sheet metal brake 100 with the second front face 118 against a second adjustable front stop 50 of the adjustable jig 10 as shown in FIG. 14, and making a second bend in the sheet metal section 110 with the sheet metal brake 100.

Figure 15:
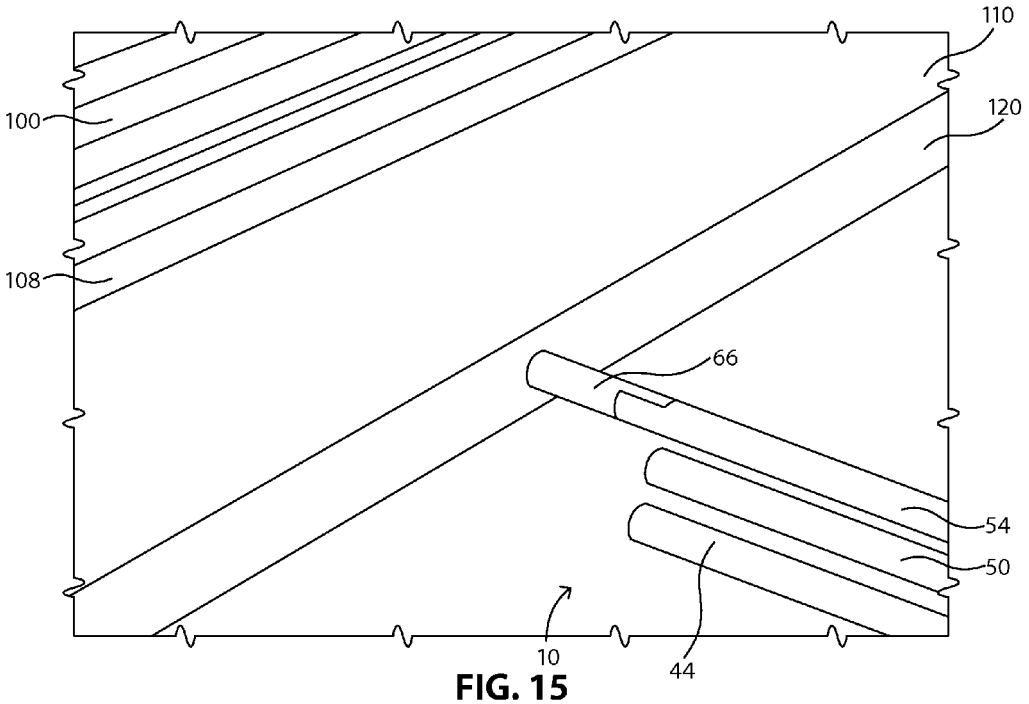
FIG. 15 is a detailed view of a section of sheet metal positioned in the sheet metal brake of FIG. 12 with a third front face of the sheet metal section positioned against a third adjustable front stop of an adjustable jig mounted to the sheet metal brake in preparation of a third bend.

As the second bend is being made another portion of the sheet metal section 110 is bent to produce a third face 120, shown in FIG. 15. In some embodiments, the method can further include repositioning the sheet metal section 110 in the sheet metal brake 100 with the third front face 120 against a third adjustable front stop 54 of the adjustable jig 10, as shown in FIG. 15, and making a third bend in the sheet metal section 110 with the sheet metal brake 100.

Figure 17:
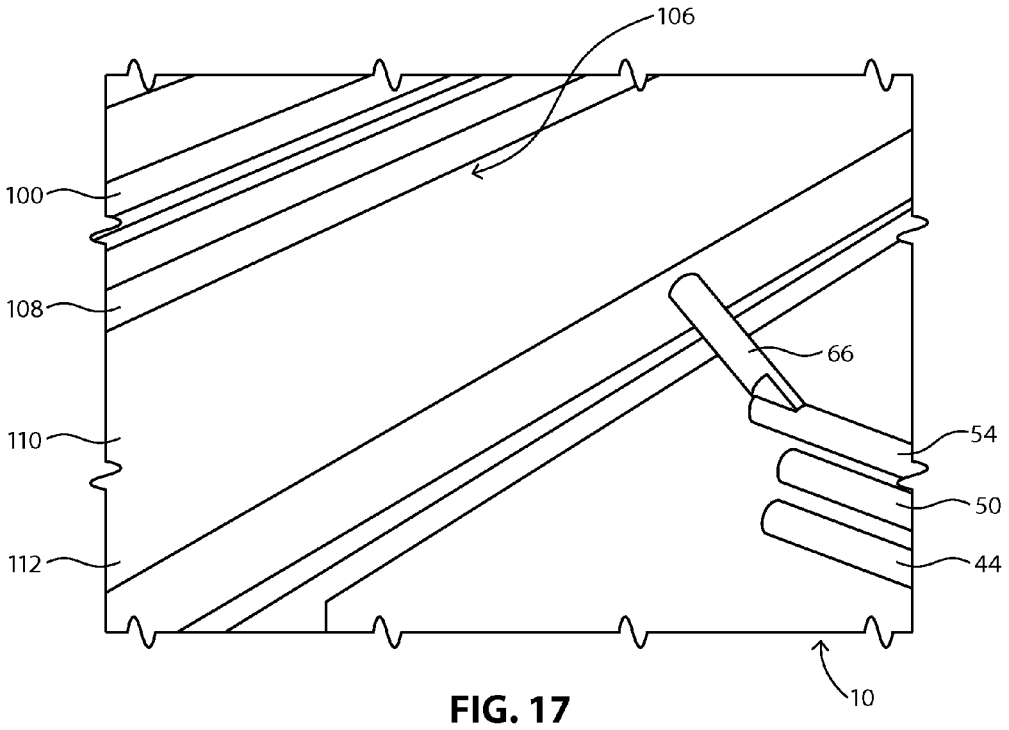
FIG. 17 is a detailed view showing a section of sheet metal moving a pivoting tip of the third adjustable front stop from a substantially horizontal orientation to a substantially vertical orientation as a fourth bend is being made.

In some embodiments, the third adjustable front stop 54 can include a pivoting tip 66 movable between a substantially horizontal orientation and a substantially vertical orientation. The method can further include repositioning the sheet metal section 110 in the sheet metal brake 100 with a portion 112 of the sheet metal section 110 extending in a downward direction from the front face 106 of the sheet metal brake 100, as shown in FIG. 16, and making a fourth bend in the sheet metal section 110 with the sheet metal brake 100 such that the portion 112 of the sheet metal section 110 extending in a downward direction from the front face 106 of the sheet metal brake 100 moves the pivoting tip 66 of the third adjustable front stop 54 from the horizontal orientation to the vertical orientation, as shown in FIG. 17.

In some embodiments, repositioning the sheet metal section 110 in the sheet metal brake 100 can include rotating the sheet metal section such that a front face is oriented toward the back of the sheet metal brake 100, or flipping the section of sheet metal 110 front to back. In some embodiments, repositioning the sheet metal section 110 in the sheet metal brake 100 includes flipping the sheet metal section 110 end over end. In some embodiments, repositioning the sheet metal section 110 in the sheet metal brake 100 includes flipping the sheet metal section end over end and rotating the sheet metal section 110 such that a front face is oriented toward the back of the sheet metal brake 100, or flipping the section of sheet metal 110 front to back.

In some embodiments, making a bend in the sheet metal section 110 includes making a substantially ninety degree perpendicular bend in the sheet metal section 110. In other embodiments, making a bend in the sheet metal section includes making a bend of between 20 and eighty-five degrees in the sheet metal section 110.

In some embodiments, the method further includes the step of mounting the adjustable jig 10 to the sheet metal brake 100 by clamping a brake clamp 22 of the adjustable jig 10 onto a rear rail 102 of the sheet metal brake 100, as shown in FIG. 2.

Thus, although there have been described particular embodiments of the present invention of a new and useful Adjustable Compound Bending Jig For Manual Metal Brake, it is not intended that such references be construed as limitations upon the scope of this invention except as set forth in the following claims.

What is claimed is:

1. An adjustable jig for a sheet metal brake, the adjustable jig comprising:

a first arm configured to mount to the sheet metal brake;

an adjustable backstop affixed on the first arm, wherein the adjustable backstop is set at an adjustable first distance from a front face of the brake when the first arm is mounted to the sheet metal brake;

a first adjustable front stop configured to engage the first arm and retain an adjustable first front stop position relative to the first arm; and a second adjustable front stop configured to engage the first arm and retain an adjustable second front stop position relative to the first arm;

wherein the first and second adjustable front stops are independently adjustable relative to the first arm.

2. The adjustable jig of claim 1, further comprising:

a first front stop clamp disposed on the first arm, the first front stop clamp configured to retain the first adjustable front stop in the adjustable first front stop position; and a second front stop clamp disposed on the first arm, the second front stop clamp configured to retain the second adjustable front stop in the adjustable second front stop position.

3. The adjustable jig of claim 1, wherein:

the first adjustable front stop is movable to a first desired set point relative to the front face of the brake when the first arm is mounted to the brake;

the second adjustable front stop is movable to a second desired set point relative to the front face of the brake when the first arm is mounted to the brake; and the first desired set point is offset from the second desired set point.

4. The adjustable jig of claim 1, wherein when the first arm is mounted to the sheet metal brake and in an upright position:

the first adjustable front stop has a first elevation;

the second adjustable front stop has a second elevation;

the first and second elevations are offset; and the first elevation is higher than the second elevation.

5. The adjustable jig of claim 1, further comprising a third adjustable front stop configured to engage the first arm and retain an adjustable third front stop position relative to the first arm, the third adjustable front stop having a pivoting tip movable between a horizontal orientation and a vertical orientation when the first arm is mounted to the sheet metal brake and in an upright position and the third adjustable front stop is engaging the first arm, wherein the pivoting tip is biased in the horizontal orientation.

6. The adjustable jig of claim 5, wherein each of the first, second, and third adjustable front stops has a pivoting tip movable between a horizontal orientation and a vertical orientation when the first arm is mounted to the sheet metal brake and in an upright position.

7. The adjustable jig of claim 5, wherein when the first arm is mounted to the metal brake and in an upright position:

the first adjustable front stop has a first elevation;

the second adjustable front stop has a second elevation;

the third adjustable front stop has a third elevation;

the first, second, and third elevations are offset from one another;

the first elevation is higher than the second elevation; and the second elevation is higher than the third elevation.

8. The adjustable jig of claim 7, wherein the first, second, and third adjustable front stops are independently adjustable relative to the first arm.

9. The adjustable jig of claim 1, wherein the first arm further comprises a brake clamp configured to clamp to a rear rail of the sheet metal brake to mount the adjustable jig to the sheet metal brake.

10. The adjustable jig of claim 1, further comprising:

a second arm configured to mount to the sheet metal brake;

a second adjustable back stop affixed to the second arm;

a second arm first adjustable front stop configured to engage the second arm and retain an adjustable second arm first front stop position relative to the second arm; and a second arm second adjustable front stop configured to engage the second arm and retain an adjustable second arm second front stop position relative to the second arm.

11. The adjustable jig of claim 10, wherein the first and second arms are configured to mount to opposing ends of the sheet metal brake.

12. The adjustable jig of claim 10, further comprising:

a first arm third adjustable front stop configured to engage the first arm and retain an adjustable third front stop position relative to the first arm; and a second arm third adjustable front stop configured to engage the second arm and retain an adjustable second arm third front stop position relative to the second arm, wherein each of the third adjustable front stop and the second arm third adjustable front stop has a pivoting tip movable between a horizontal orientation and a vertical orientation when the first and second arms are mounted to the sheet metal brake and in an upright position.

* * * * *